US006162072A

United States Patent [19]

Hoyer et al.

[11] Patent Number: 6,162,072

[45] Date of Patent: Dec. 19, 2000

[54] ELECTRICAL CONNECTOR WITH ACTUATING DEVICE

[75] Inventors: Jörg Heiner Hoyer, Ettlingen; Alexander Popa, Karlsbad; Manfred Karl Süss, Remchingen, all of Germany

[73] Assignee: Molex Incorporated, Lisle, Ill.

[21] Appl. No.: 09/335,657

[22] Filed: Jun. 18, 1999

[30] Foreign Application Priority Data

Jul. 1, 1998 [DE] Germany ..... 298 11 589 U

[51] Int. Cl.[7] ..... H01R 13/62

[52] U.S. Cl. ..... 439/157; 439/160

[58] Field of Search ..... 439/157, 160

[56] References Cited

U.S. PATENT DOCUMENTS

| | | | |
|---|---|---|---|
| 5,709,560 | 1/1998 | Hio | 439/157 |
| 5,810,612 | 9/1998 | Flask et al. | 439/157 |
| 5,947,762 | 9/1999 | Katsuma | 439/157 |
| 5,957,710 | 9/1999 | Nagano | 439/157 |

*Primary Examiner*—Khiem Nguyen
*Assistant Examiner*—Hae Moon Hyeon
*Attorney, Agent, or Firm*—Stacey E. Caldwell

[57] ABSTRACT

An electrical connector having a first and a second connector housing, each of which holds electrical contacts and which can be mated to bring the contacts of the first and of the second connector housing into contact with one another. The connector includes an actuating device in the form of a lever pivotably mounted on the first connector housing and movable between first and second positions, wherein the actuating device is held in the first position by a safety device, which allows the actuating device to be moved to the second position only after the first connector housing has been correctly positioned with the second connector housing. The first connector housing is moved relative to the second connector housing during the movement of the actuating device thus facilitating correct mating of the two connector housings, particularly when space conditions present a problem.

6 Claims, 4 Drawing Sheets

ELECTRICAL CONNECTOR WITH ACTUATING DEVICE

FIELD OF THE INVENTION

This invention relates generally to a connector assembly comprising a pair of mating connector housings and, more particularly, to a such a connector assembly that includes a lever for facilitating the mating of the connectors wherein the lever can be moved into its locked position only upon proper positioning of the connectors.

BACKGROUND OF THE INVENTION

Connectors are used in a great variety of ways, for example in the automotive industry, to connect the various kinds of electrical and electronic components in motor vehicles to one another. These connectors often have a large number of electrical contacts and involve excessive forces and therefore necessitate actuating devices, such as levers, to facilitate mating. However, when such actuating devices are used, defined start and stop positions for the actuating devices must be established before the start and at the end of the mating of the connector housings or before and after the connector housings are separated. This creates additional space requirements, which, particularly in cramped situations, such as may arise during assembly and mating behind a dashboard, make it difficult to access or actuate the actuating devices. Assembly and mating are made even more difficult in these situations since the connectors are typically arranged very close together, such as in strip arrangements or cabling boxes.

The invention is therefore based on the object of simplifying the mating of a pair of connectors of this type, particularly when space conditions present a problem, and, at the same time reliably ensuring that the connectors are mated correctly

SUMMARY OF THE INVENTION

The subject invention is therefore directed to a pair of mating connectors which include an actuating device for facilitating mating of the connectors, whereby the actuating device is blocked against movement in a first position by a safety device, which safety device allows the actuating device to be moved only after the first connector housing has been properly positioned on the second connector housing. In this way, even in the most cramped of situations, the actuating device cannot be moved unintentionally, thus avoiding inadvertent movement of the actuating device and unintentional unmating of the connectors. Not until the first connector housing has been positioned correctly on the second connector housing is the actuating device released, and the two connector housings allowed to be finally mated. This method also prevents the possibility of premature electrical contact, for example if one of the connector housings is forced into the other incorrectly.

The actuating device is in the form of a pivotable lever positioned on the first connector housing so that small rotational forces are sufficient to allow connectors with a large number of contacts to be reliably mated and separated.

The safety device is in the form of a latching lug arranged on the first connector housing in front of one portion of the lever when the first and the second connector housing are not mated. When the first connector housing is mated with the second connector housing, the latching lug is moved out of the path of the portion of the lever by a region of the second connector housing.

The lever comprises a first pivot arm extending perpendicular to a second pivot arm on which the portion that can be blocked by the latching lug is arranged. In this case the desired force-and movement-transmission ratios and blocking forces of the safety device can be set using the length of the two pivot arms. With such an arrangement, the second pivot arm can move into the second connector housing, and protection for the blocking device and for the pivot arm is made possible.

The blockable portion is arranged at that end of the second pivot arm remote from the pivot point, and forms a lateral shoulder to create a stop for the mating of the connectors, this stop defining a precise end position of the mated connectors. Furthermore, maximum lever forces are then produced for the blocking action of the safety device.

When the lever is pivoted between the first and second position, a second safety device holds the lever in its second position secured against pivoting. In this "closed" second position, the mated connector is also protected against vibration and impacts in the even of unintentional opening. The second safety device is generally wedge-shaped latching lug which protects from the first connector housing and, in the second position of the lever, engages behind a central portion of the first pivot arm.

A groove runs along the second pivot arm and when the first connector housing is mated with the second connector housing, a projection of the second connector housing moves into this groove and the groove exerts a force on the projection when the lever is pivoted, causing the first connector housing to move relative to the second connector housing.

The connector can include a device for tactile indication when the connector housings are mated or separated, wherein the groove has an elevated region which extends towards the exterior and forms a mechanical resistance for the projection of the second connector housing when the connector housings are mated and separated.

The above and other objects and features of the present invention will be more apparent from the following description taken in conjunction with the accompanying drawings.

DETAILED DESCRIPTION OF THE INVENTION

Figure 1:
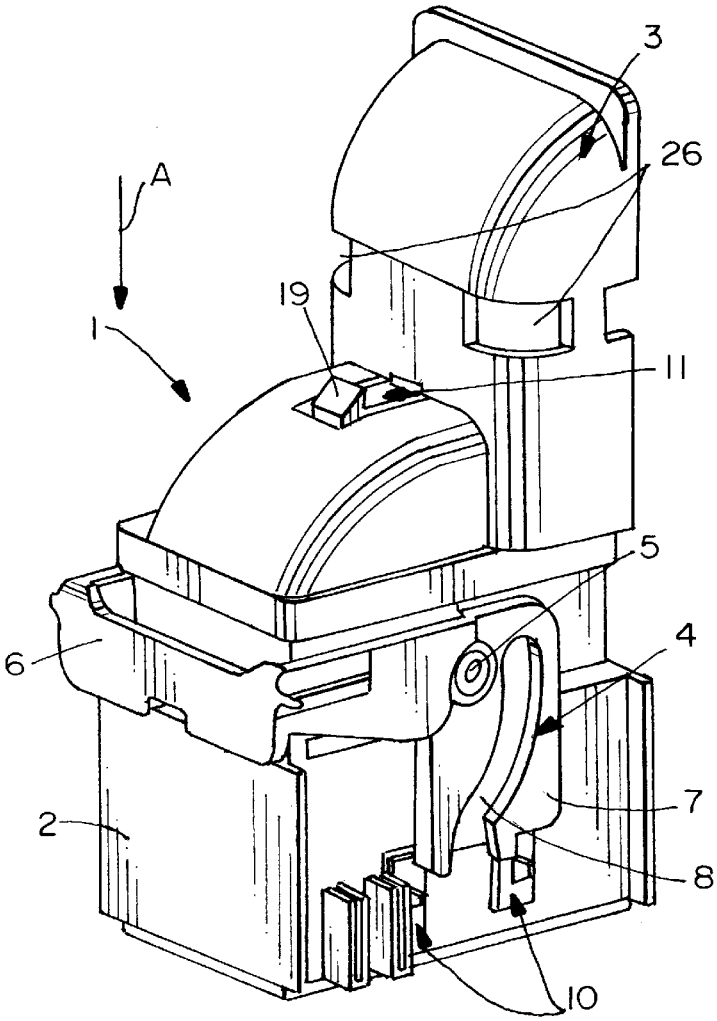
FIG. 1 is a perspective view of a first connector housing of the invention showing the lever in its first position.
Figure 4A:
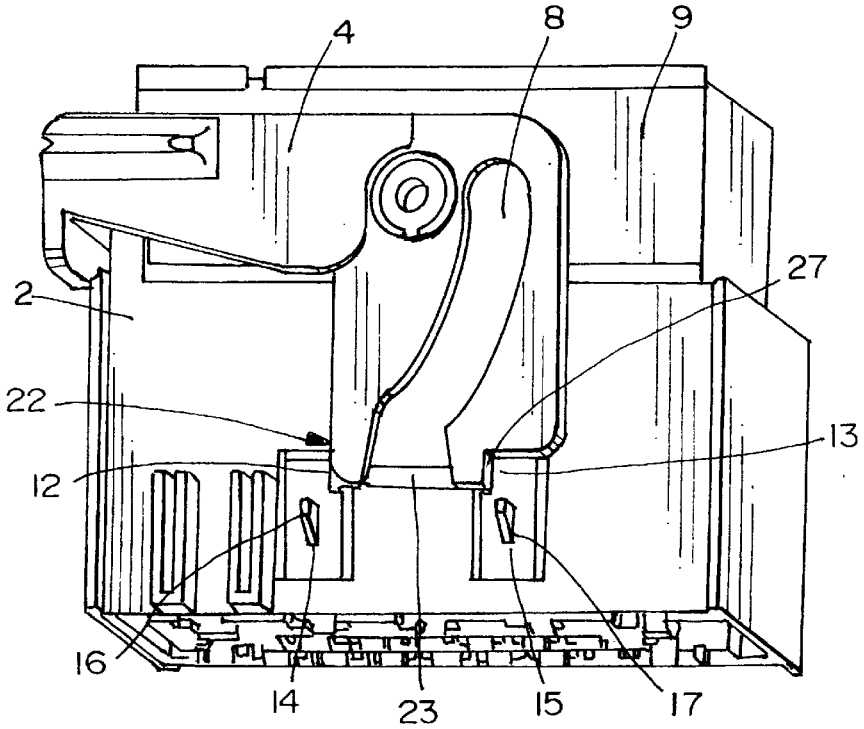
FIG. 4A is a side perspective view of the first connector housing showing the lever in its first position.
Figure 5:
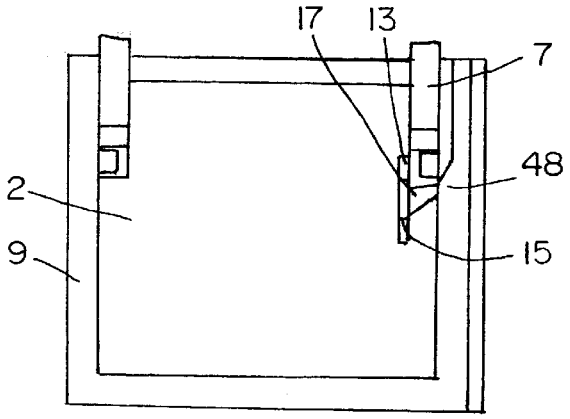
FIG. 5 is a sectional illustration taken perpendicular to the pivot axis of the lever and lying in the plane of one of the latching lugs of the first safety device, wherein the first connector housing is partially inserted into the second connector housing, and the first safety device, associated with the lever, has just opened.
Figure 6:
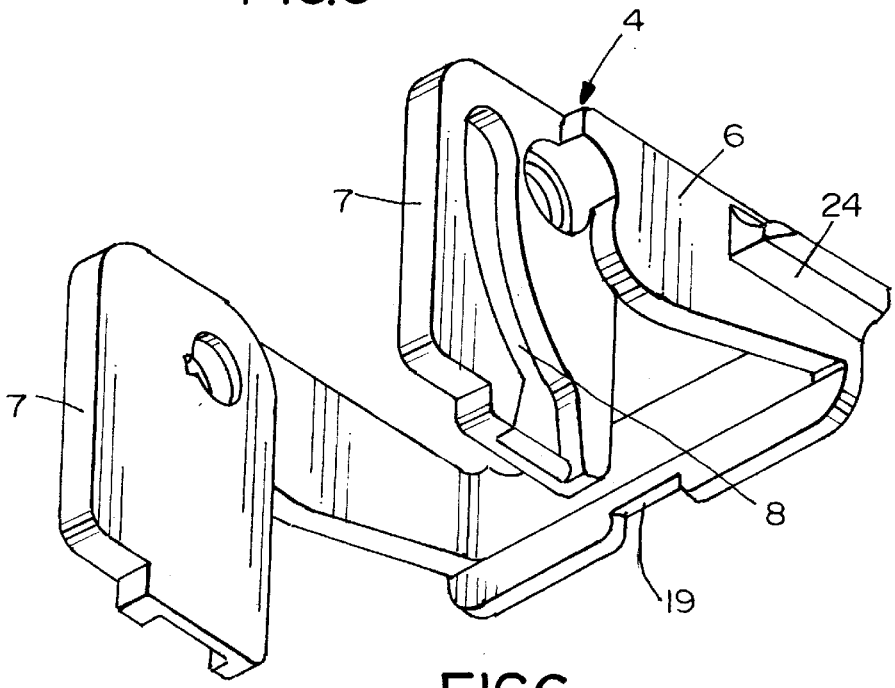
FIG. 6 is a perspective view of the lever removed from connector housing.
Figure 4B:
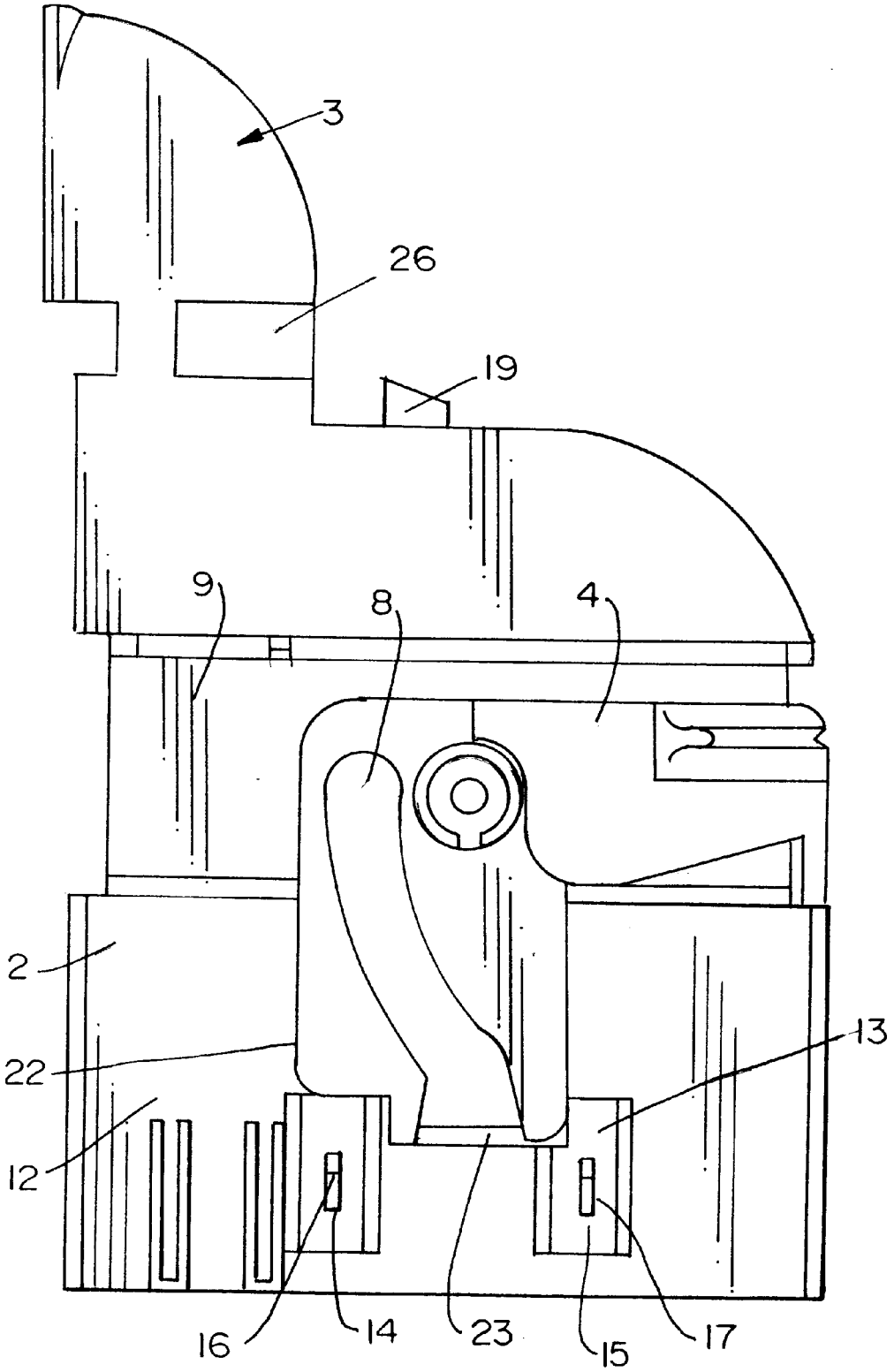
FIG. 4B is a side perspective view of the first connector housing showing the lever and cap rotated 180° relative to the base body.

FIG. 1 shows a first connector housing 1 comprising a base body 2, a cap 3 for fitting onto the base body and a lever 4. Cap 3 fits onto base body 2 in two positions and lever 4 fits onto base body 2 in two corresponding positions rotated 180°. Therefore lever 4 can be pivotable upward from the left or from the right as shown in FIGS. 4A and 4B. Lever 4 is pivotally held on base body 2 so that it can rotate about a pivot point 5. Lever 4 comprises a first pivot arm 6 having a general U shape and a second pivot arm 7 arranged perpendicular to first pivot arm 6 at each end thereof (FIG. 6). Each pivot arm 7 includes a groove 8 open toward the outside of the pivot arm.

A projection (not shown) extends inwardly from the side of second connector housing 9 and is adapted to enter groove 8, with the result that, when lever 6 is pivoted, groove 8 exerts forces transmitted by pivot arm 7 on the projection of the second connector housing, which causes relative movement between first connector housing 1 and second connector housing 9. As a result, lever 4, groove 8 and the extension of second connector housing 9 create an actuating device which transforms the rotational movement of lever 6 into linear movement of the first connector housing in relation to the second connector housing for mating or separating the two connector housings 1, 9.

Figure 2:
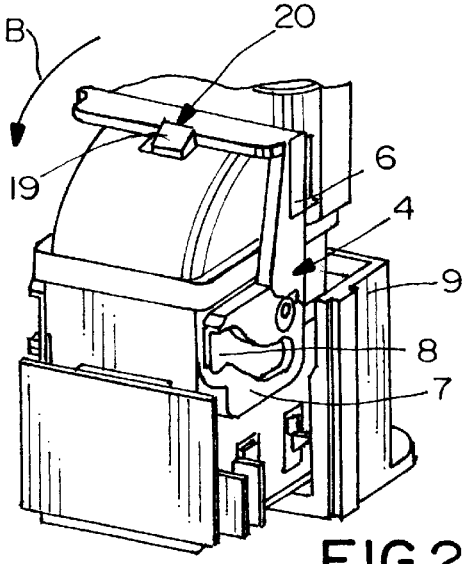
FIG. 2 is a perspective view of the first connector housing being inserted into a second connector housing and showing the lever in its second position.
Figure 3:
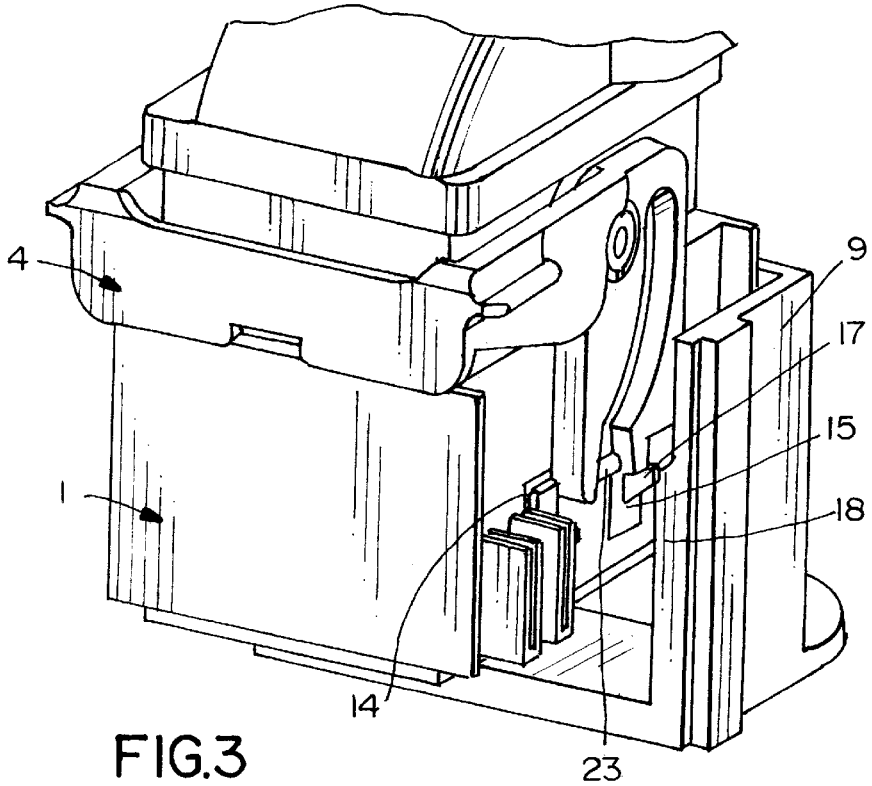
FIG. 3 is an enlarged perspective view showing the first connector housing as in FIG. 2.

Lever 4 is pivotable between a first position, shown in FIGS. 1, 3 and 4, and a second position, shown in FIG. 2, when a respective first safety device 10 and a respective second safety device 11 preventing pivoting are released.

First safety device 10 comprises two latching lugs 12, 13 which each comprise a corner of a cover plate 14, 15 formed on base body 2 (see FIG. 4). Cover plates 14, 15 are inclined slightly from the side wall of base body 2, so that the pivoting movement of the lower portion of second pivot arm 7 causes a mechanical resistance to be encountered. See FIG. 3, in particular, in which the front part of the lower portion of pivot arm 7 is blocked by cover plate 14 to prevent lever 4 from pivoting upward.

Cover plates 14, 15 cantilevered from a base portion thereof, each comprise lugs 16, 17 which project from the side of base body 2 and form ramp-shaped insertion-aiding faces in their lower portion.

When first connector housing 1 is inserted into second connector housing 9 with the lever situated in its first position and secured against pivoting (FIGS. 1,3 and 4), the second connector housing 9 provides a free space for lugs 16 and 17, which means that lever 4 continues to be held in its first position at the start of the mating operation.

However, as the connector housings move together, lug 17 is pressed inwardly by a region 18 of second connector housing 9, a portion of which extends inwardly from the interior of second connector housing 9, and causes cover plate 15 and latching lug 13 to pivot inwardly toward the interior of base body 2, thus releasing the lock preventing lever 4 from being pivoted.

In the same way, a corresponding region (not shown) is associated with the lug 16 and includes a portion of second connector housing 9 which extends inwardly to cause cover plate 14 to be pressed in and latching lug 12 to retract, which enables lever 4 to pivot to both sides.

It is within the scope of the invention to offset the release torque for latching lug 12 from the release torque for latching lug 13. Furthermore, the design of region 18 on second connector housing 9 can be used to select the point at which lever 4 is released, such that lever 4 can always be reliably released before electrical contact is made. This means that the position of the electrical contacts (not shown in the figures) in base body 2 of first connector housing 1 and second connector housing 9 relative to the pivoting movement of lever 4 is designed such that electrical contact is not made until the time when lever 4 moves out of its first position into its second position. As a result, high mechanical forces arising in the mating direction of the connector housings are translated into smaller pivoting forces at lever 4.

In an alternative embodiment according to the invention, region 18 can comprise the lower end of a groove extending along a side of second connector housing 9, the groove running at an angle into the lower region of the housing with respect to the inner wall. It is essential to the invention merely that, after a defined position in which the first and the second connector housing are at least partially mated, lever 4 is released from its first position, preferably by means of a simple pressing force in the mating direction.

Figure 7:
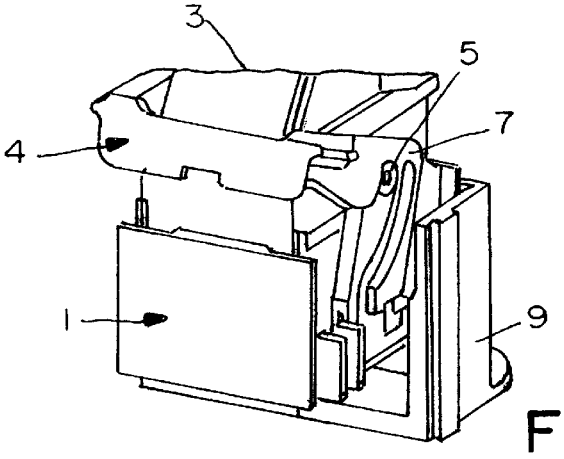
FIG. 7 is a perspective view of the first connector housing at an angle, with the lever in an intermediate position between the first and the second position, and the first connector housing being inserted into a second connector housing.

If the lever has been moved out of its first position by means of a slight pressure and is in the position shown in FIG. 7, for example, it can easily be grasped, and, as a result of it being pivoted further upwards, groove 8, engaging with the lateral projection of second connector housing 9, causes the second connector housing to mate fully with the first.

When lever 4 reaches its second position, i.e. its upper end position, the U-shaped central portion of first pivot arm 6 catches a wedge shaped latching lug 19 of a second safety device 11 preventing pivoting. In this position of lever 4, shown in FIG. 2, latching lug 19 is flush behind a rectangular recess 20 in the central portion of the second pivot arm 6 of lever 4, thus preventing the lever from pivoting out of the second position.

Only after latching lug 19 has deliberately been pushed in can lever 4 be pivoted downward again in the direction denoted by arrow "B" in FIG. 2, which at the same time moves second pivot arm 7 and means that forces are exerted on the projection of second connector housing 9 via groove 8, these forces causing the two connector housings to be separated from one another.

When lever 4 is moved further away from the second position, it ultimately reaches the position shown in FIG. 4, whereat a lateral shoulder on the lower portion of the second lever arm 7 rests against latching lug 13.

When connector housings 1, 9 are pulled apart, latching lug 12 moves forward to rest against shoulder 22 opposite first lateral shoulder 21 at the lower end of second pivot arm 7. This means that lever 4 is again secured against pivoting, and in this position first connector housing 1 can be separated from second connector housing 9.

The point of transition from the pivoting movement of lever 4 to a pure mechanical pulling movement of the connector housings can be provided with a tangible resistance or latching device to prevent connector housing 1 from falling inadvertently being disconnected from connector housing 9. Such a latching device is shown by elevated region 23 (FIGS. 3 and 4) wherein the lateral projection of housing 9 encounters a mechanical resistance when first connector housing 1 is removed or inserted.

Lever 4 may further be provided with laterally projecting side ribs 24 (FIG. 6) arranged at an end of pivot arm 6 remote from the pivot point to facilitate rotation of the lever by providing areas for gripping the lever easily.

Cap 3 of first connector housing 1 can comprise a strain-relief device 25 whose longitudinal axis extends essentially in the form of a trough in the mating direction of the connectors, i.e. in the mating direction of the arrow "A" in FIG. 1, and which has slots 26 for attaching cable ties. This allows cables leading to the connection contacts of the first connector housing 1 to be protected inside the trough-shaped strain-relief device and reliably held on strain-relief device 25 by the cable ties (not shown).

Other refinements, such as making groove 8 in second connector housing 9 and providing pivot arm 7 with a projection associated with groove 8, are within the scope of the invention.

In addition, the second connector housing can be arranged on an electrical distributor strip inside a motor vehicle or be designed integrally with the strip.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector comprising a first connector housing mates with a second connector housing, each of which holds electrical contacts and which can be mated to bring the contacts of the first end of the second connector housing into contact with one another;

an actuating device in the form of a lever pivotably mounted on the first connector housing for movement between a first and a second position wherein the first connector housing is moved relative to the second connector housing during the movement of the actuating device between the first and second positions, a safety device holds the lever in the first position and allow the actuating device to be moved only after the first connector housing a properly positioned with respect to the second connector housing wherein the safety device comprises a latching lug arranged on the first connector housing which blocks movement of the lever and wherein, when the first connector housing is mated with the second connector housing, the latching lug is moved out of the path of the lever, wherein the lever comprises a first pivot arm, and a second pivot arm extending generally perpendicular to the first pivot arm wherein the second pivot arm includes a lockable portion which is blocked by the latching lug wherein the lockable portion is arranged at an end of the second pivot arm and forms a lateral shoulder which forms a limit stop for the latching lug when the connector housings are mated.

2. An electrical connector comprising a first connector housing mates with a second connector housing, each of which holds electrical contacts and which can be mated to bring the contacts of the first and of the second connector housing into contact with one another;

an actuating device in the form of a lever pivotably mounted on the first connector housing for movement between a first and a second position wherein the first connector housing is moved relative to the second connector housing during the movement of the actuating device between the first and second positions.

a first safety device holds the lever in the first position and allow the actuating device to be moved only after the first connector housing is properly positioned with respect to the second connector housing, a second safety device holds the lever in its second position such that it is secured against pivoting, wherein the second safety device is a wedge-shaped latching lug which project from the first connector housing and, in the second position of the lever, engages behind a central portion of the first pivot arm.

3. An electrical connector comprising a first connector housing mates with a second connector housing, each of which holds electrical contacts and which can be mated to bring the contacts of the first and of the second connector housing into contact with one another;

an actuating device in the form of a layer pivotably mounted on the first connector housing for movement between a first and a second position wherein the first connector housing is moved relative to the second connector housing during the movement of the actuating device between the first and second positions, a first safety device holds the lever in the first position and allow the actuating device to be moved only after the first connector housing is properly positioned with respect to the second connector housing, and a cap adapted to fit on the first connector housing in one of two positions rotated 180° with respect to one another.

4. The electrical connector according to claim 3 wherein the lever is adapted to be fitted on the connector housing in one of two positions rotated 180° with respect to one another.

5. The electrical connector according to claim 3 wherein the cap has a strain-relief device which extends generally in the mating direction of the connector housings.

6. The electrical connector according to claim 5, wherein the strain-relief device includes lateral slots adapted to accommodate cable ties.

* * * * *